US006829798B2

(12) United States Patent
Wells

(10) Patent No.: US 6,829,798 B2
(45) Date of Patent: Dec. 14, 2004

(54) LOW DENSITY POCKETED SPRING ASSEMBLY AND METHOD OF MANUFACTURE

(75) Inventor: Thomas J. Wells, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 10 days.

(21) Appl. No.: 10/338,241

(22) Filed: Jan. 8, 2003

(65) Prior Publication Data

US 2004/0128771 A1 Jul. 8, 2004

(51) Int. Cl.[7] ..... A47C 23/04

(52) U.S. Cl. ..... 5/720; 5/655.8; 5/721; 5/728

(58) Field of Search ..... 5/721, 727, 267, 5/655.8, 720, 728

(56) References Cited

U.S. PATENT DOCUMENTS

| | | | | |
|---|---|---|---|---|
| 1,455,847 A | | 5/1923 | Meutsch | |
| 1,747,374 A | * | 2/1930 | MacInerney | 5/655.8 |
| 2,048,979 A | * | 7/1936 | Trotta et al. | 5/655.8 |
| 5,699,998 A | | 12/1997 | Zysman | |
| 6,029,957 A | | 2/2000 | Zysman | |
| 6,101,697 A | | 8/2000 | Stumpf et al. | |
| 6,131,892 A | | 10/2000 | Stumpf | |
| 6,143,122 A | | 11/2000 | Mossbeck et al. | |
| 6,173,464 B1 | | 1/2001 | McCune et al. | |
| 6,256,820 B1 | * | 7/2001 | Moser et al. | 5/655.8 |
| 6,272,706 B1 | | 8/2001 | McCune et al. | |
| 6,315,275 B1 | | 11/2001 | Zysman | |
| 6,367,881 B1 | | 4/2002 | Bullard et al. | |
| 6,374,442 B1 | * | 4/2002 | Wells | 5/720 |
| 6,398,199 B1 | * | 6/2002 | Barber | 267/93 |
| 6,467,240 B2 | | 10/2002 | Zysman | |
| 6,591,438 B1 | | 7/2003 | Edling | |

FOREIGN PATENT DOCUMENTS

| | | |
|---|---|---|
| CA | 1194621 | 10/1985 |
| EP | 0 089 789 | 9/1983 |
| WO | WO 02/44077 | 6/2002 |

* cited by examiner

*Primary Examiner*—Teri Pham Luu
(74) *Attorney, Agent, or Firm*—Wood, Herron & Evans, LLP

(57) ABSTRACT

A bedding or seating product comprises a pocketed spring assembly having a plurality of parallel strings of springs joined to each other. Each of said strings of springs comprises a row of interconnected pockets, each of the pockets containing at least one spring encased in a fabric pocket and with more than one line of attachment between at least selected adjacent pockets. At least one spacer strip or at least one scrim sheet extends between the interconnected pockets of at least one string of springs and is secured thereto to provide stability in the pocketed spring assembly.

19 Claims, 4 Drawing Sheets

LOW DENSITY POCKETED SPRING ASSEMBLY AND METHOD OF MANUFACTURE

FIELD OF THE INVENTION

This invention relates generally to spring assemblies for use in mattresses, spring-upholstered furniture and the like and, more particularly, to a pocketed coil spring assembly and an associated method of manufacturing such an assembly.

BACKGROUND OF THE INVENTION

A well known type of bedding or seating product comprises a pocketed spring assembly which includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the pocketed spring assembly. A row of such pocketed springs is known in the industry as a string of pocketed springs. A bedding or seating product can be fabricated from such strings of pocketed springs by binding or adhering the individual rows or strings of pocketed springs together to form a pocketed spring assembly. The pocketed spring assembly may then be padded and encased in an upholstered covering. U.S. Pat. No. 6,143,122 discloses one such method of adhesively bonding strings of pocketed springs together to form a pocketed spring assembly.

Mattresses and similar articles constructed of pocketed spring assemblies are often considered a high-end product because of the added benefits and features of the pocketed coil springs. Typically, within a string of springs, opposite plies of fabric are welded, glued, sewn, or otherwise secured together between adjacent coil springs with a generally vertically oriented seam or line of attachment. At the ends of the string of springs, an outermost seam prevents the outermost coil springs from falling out of the string of springs. A pocketed spring assembly made by joining multiple such strings of pocketed springs creates what is considered in the industry as a "high density" pocketed spring assembly due to the large number of pocketed coil springs in the spring assembly. Within each of the strings of pocketed springs, there is little space between adjacent pocketed coil springs.

One alternative to this construction of a string of springs is to manufacture a string of pocketed springs in which fewer coil springs are used in the string. One method of doing this is to sew, weld, or otherwise secure together opposed plies of fabric along two spaced, generally vertically oriented seams between adjacent pocketed coil springs. U.S. Pat. No. 2,048,979 discloses this type of construction of a string of pocketed springs. The effect of joining multiple strings of springs of this type is to reduce the number of coil springs in the pocketed spring assembly, thereby creating a "low density" pocketed spring assembly. One advantage of a "low density" pocketed spring assembly is that fewer springs are required than in a conventional "high density" pocketed spring assembly. One drawback to such a "low density" pocketed spring assembly is that due to the fabric between adjacent pocketed coil springs, one or more of the strings of springs of the assembly may collapse in a longitudinal direction, adjacent pocketed springs moving together. Therefore, there is a need for some additional structure to stabilize the strings of springs of the "low density" pocketed spring assembly and prevent them from collapsing inwardly.

U.S. Pat. No. 2,048,979 discloses one method of preventing the strings of springs of a "low density" pocketed spring assembly from collapsing. U.S. Pat. No. 2,048,979 discloses wires in both the top and bottom surfaces of the pocketed spring assembly which are bent around the end turns of the pocketed coil springs to prevent the strings of springs from collapsing. One drawback to this pocketed spring assembly is that it is expensive to manufacture due to the necessary manipulation or bending of the wires.

Therefore, there is a need for a "low density" pocketed spring assembly, i.e. made of strings of pocketed springs in which more than one seam separates adjacent pocketed springs, which is structurally rigid and will not collapse. There is a further need for a pocketed coil spring assembly which may be manufactured less expensively than heretofore known pocketed spring assemblies, yet is stable. Additionally, there is a need for a "low density" pocketed spring assembly which may be manufactured without the higher manufacturing costs, production difficulties, and inefficiencies associated with known "low density" pocketed spring assemblies.

SUMMARY OF THE INVENTION

The invention of this application which accomplishes these and other objectives comprises a bedding or seating product comprising a pocketed spring assembly, padding and an upholstered covering encasing the pocketed spring assembly and padding.

The pocketed spring assembly comprises a plurality of parallel strings of springs joined to each other, each of the strings of springs comprising a row of interconnected fabric pockets. Each of the pockets contains at least one spring encased in fabric. The springs are preferably coil springs but may be other types of springs. In the event coil springs are used, each of the coil springs has a central axis, an upper end turn, a lower end turn, and a plurality of central convolutions between the end turns. Preferably, each string of springs is made of one piece of fabric folded and welded into a plurality of pockets, each of the pockets containing at least one spring. Opposed plies of the string of springs may be joined by sewing, gluing, sonic welding or any other method known in the art.

Each string of springs is contained within a longitudinally extending row of integrally connected closed fabric pockets, each pocket of which contains one helically coiled wire compression spring having its axis disposed transversely of the row. The pockets are defined between two overlapped plies of fabric by spaced transverse lines of attachment or seams of the plies to one another and by connection of the plies together along a longitudinally extending line of attachment or seam.

In one preferred embodiment of the present invention, a spacer strip extends between and is secured to the top surface of each row of interconnected pockets of each string of springs. Therefore, each string of springs has a single spacer strip extending between the interconnected pockets of the string of springs, intersecting the axes of the coil springs. The spacer strips may be secured to the fabric pockets by gluing, welding or any other suitable method. Thus, each spacer strip extends longitudinally, parallel its associated string of springs. Each spacer strip is preferably made of plastic but may be made of any suitable material.

In another preferred embodiment, spacer strips are secured to selected strings of springs, for example, every other string of springs. A spacer strip may be secured to the top or bottom surface of the string of springs, or both the top and bottom surfaces of the strings of springs. More than one spacer strip per string of springs is also contemplated by the present invention.

In yet another preferred embodiment of the present invention, at least one scrim sheet may be secured to the strings of springs to prevent the strings of springs from collapsing longitudinally. In this embodiment, at least one scrim sheet is glued, ultasonically welded or otherwise secured to the fabric of the strings of springs. The scrim sheet or sheets may be secured to each string of springs or only select strings of springs.

In any of the preferred embodiments described above, the strings of springs may be oriented transversely or longitudinally of the bedding or seating product.

In one method of manufacturing a bedding or seating product in accordance with the present invention, the pockets of the strings of springs are filled with at least one spring before being closed. Preferably, each pocket is closed immediately after the spring is inserted therein. In accordance with the practice of this invention, some, if not all, of the adjacent pockets of a string of pocketed springs are separated by more than one line of attachment so as to create a so-called "low density" string of pocketed springs. The finished string of "low density" pocketed springs is then joined to adjacent finished strings of springs to form a pocketed spring assembly. In one embodiment of the present invention, at least one spacer strip is then secured along the length of each of the strings of springs to prevent its collapse. Alternatively, the spacer strips can be secured to the strings of springs prior to joining adjacent strings of springs together. Either way, once the strings of springs have been attached to each other, thereby forming a pocketed spring assembly, the pocketed spring assembly is covered with padding and encased in a fabric covering.

These and other objects and advantages of the invention will be more readily apparent from following description of the drawings in which:

BRIEF DESCRIPTION OF THE DRAWINGS

These objectives and features of the invention will become more readily apparent from the following detailed description, taken in conjunction with the accompanying drawings in which.

DETAILED DESCRIPTION OF THE DRAWINGS

Figure 1:
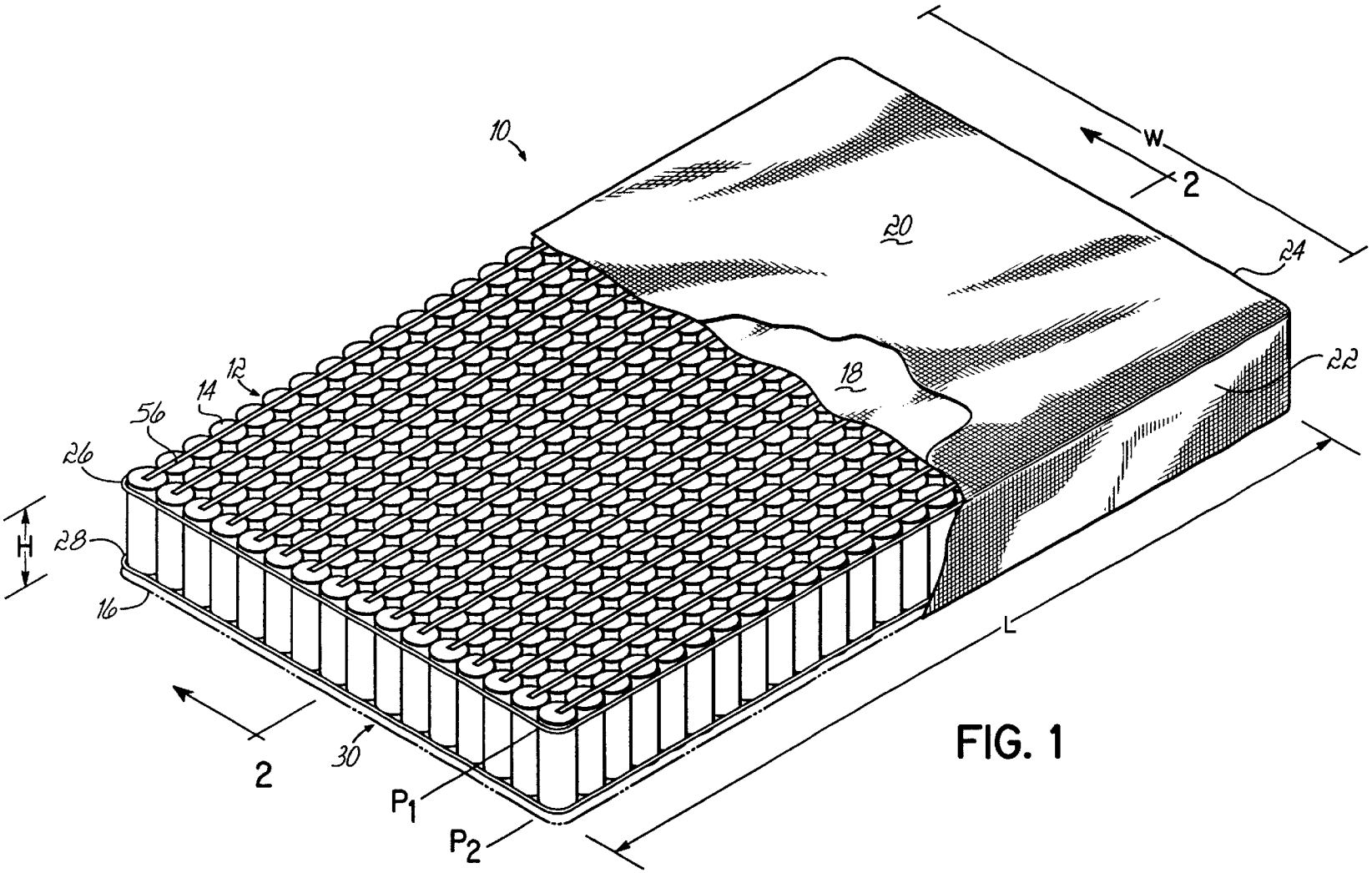
FIG. 1 is a perspective view of a bedding or seating product having a pocketed spring assembly according to one preferred embodiment of this invention.

Referring to the drawings, particularly to FIG. 1, there is illustrated a bedding or seating product in the form of a mattress 10. Although a mattress 10 is illustrated, the present invention may be used to construct any bedding or seating product. The mattress 10 comprises a pocketed spring assembly 12 having a generally planar top surface 14 in a top plane P1 and a parallel generally planar bottom surface 16 in a bottom plane P2. Covering pads 18 (only one being shown) may be located on the top and bottom surfaces of the pocketed spring assembly 12. An upholstered covering 20 encases the pocketed spring assembly 12 and the covering pads 18.

The mattress 10 has a height H defined as the distance between the top and bottom surfaces 14, 16 of the pocketed spring assembly 12. Similarly, the mattress 10 has a transverse dimension or width W defined as the distance between opposed side surfaces 22 and a longitudinal dimension or length L defined as the distance between opposed end surfaces 24 of the mattress 10. The longitudinal dimension is illustrated as being larger than the transverse dimension of the mattress 10, although it is within the contemplation of the present invention that the longitudinal and transverse dimensions be identical, such as in a square product.

If desired, at least one border wire may be secured to the pocketed spring assembly 12 with hog rings or any other conventional fastener. FIG. 1 illustrates an upper border wire 26 and a lower border wire 28, both of which are generally rectangular, secured to the pocketed spring assembly 12. However, only one border wire may be used or none at all in accordance with the present invention.

In the preferred embodiment illustrated in FIG. 1, the pocketed spring assembly 12 comprises a plurality of longitudinally extending strings of springs 30. Although the strings of springs 30 are illustrated as extending longitudinally, this embodiment of the present invention may also be manufactured with strings of springs extending from side-to-side or transversely.

Figure 2:
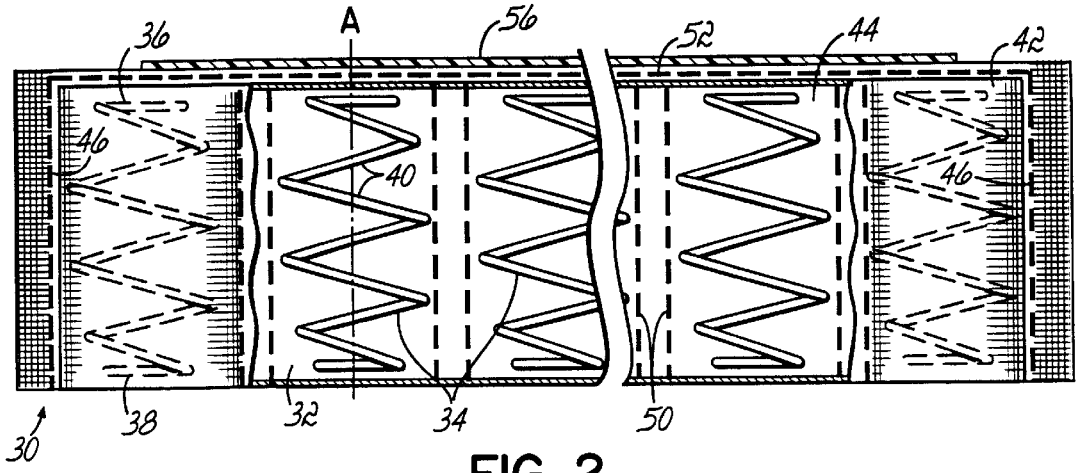
FIG. 2 is a cross-sectional view taken along line 2—2 of FIG. 1.

As best illustrated in FIG. 2, each string of springs 30 comprises a row of interconnected fabric pockets 32. Each of the fabric pockets 32 contains at least one coil spring 34 having a central or longitudinal axis A, an upper end turn 36, a lower end turn 38, and a plurality of central convolutions 40 between the end turns 36, 38. Preferably, one piece of fabric is used to form a string of springs, the piece of fabric being folded over onto itself around the coil springs. As is known in the art, opposite sides or plies 42, 44 of the fabric are sewn, welded, or otherwise secured together in order to create a pair of outermost lines of attachment or seams 46, a plurality of internal lines of attachment or seams 50, and a top line of attachment or seam 52. Although FIG. 2 illustrates the line of attachment or seam 52 extending longitudinally along the top of the string of springs 30, alternatively, it may extend longitudinally along either side or the bottom of the length of the string of springs 30, as is known in the art.

In accordance with the present invention, at least one internal seam or line of attachment 50 separates adjacent pockets 32 and, therefore, adjacent pocketed coil springs 34. As described hereinabove, multiple internal lines of attachment 50 reduce the number of pocketed coil springs used in pocketed spring assembly 12, thereby creating what is known in the industry as a "low density" pocketed spring assembly. Although the seams are illustrated as being a plurality of spaced, linear segments, they may comprise continuous lines or a series of dots or other arrangement without departing from the spirit of this application. And alternatively only selected adjacent coil springs in a string of pocketed coil springs rather than all coils of a string of pocketed springs may be separated by multiple lines of attachment with the result that only selected areas of the resulting pocketing coil spring assembly may be of "low density."

In a preferred embodiment illustrated in FIG. 1, an extruded rigid plastic spacer strip 56 extends between each row of interconnected pockets of each string of springs 30 and is secured thereto. Each plastic spacer strip 56 is preferably glued to the fabric of a string of springs 30 but may be ultrasonically welded or secured with any other adequate method. Although spacer strips 56 are preferably made of extruded plastic, they may be made of any other suitable relatively rigid material.

As shown in FIG. 1, one linear spacer strip 56 may be secured to the top surface of each string of springs 30. If desired, additional spacer strips 56 may be secured to the bottom or side surfaces of each string of springs 30. In the embodiment illustrated in FIG. 1, the linear spacer strip 56 is centrally located along the length of the string of springs 30 and intersects the axes A of the pocketed coil springs 34.

Although only one spacer strip 56 per string of springs 30 is shown in FIG. 1, it is within the contemplation of the present invention that more than one spacer strip 56 be attached to the upper or lower surface or both surfaces of a string of springs.

Figure 1A:
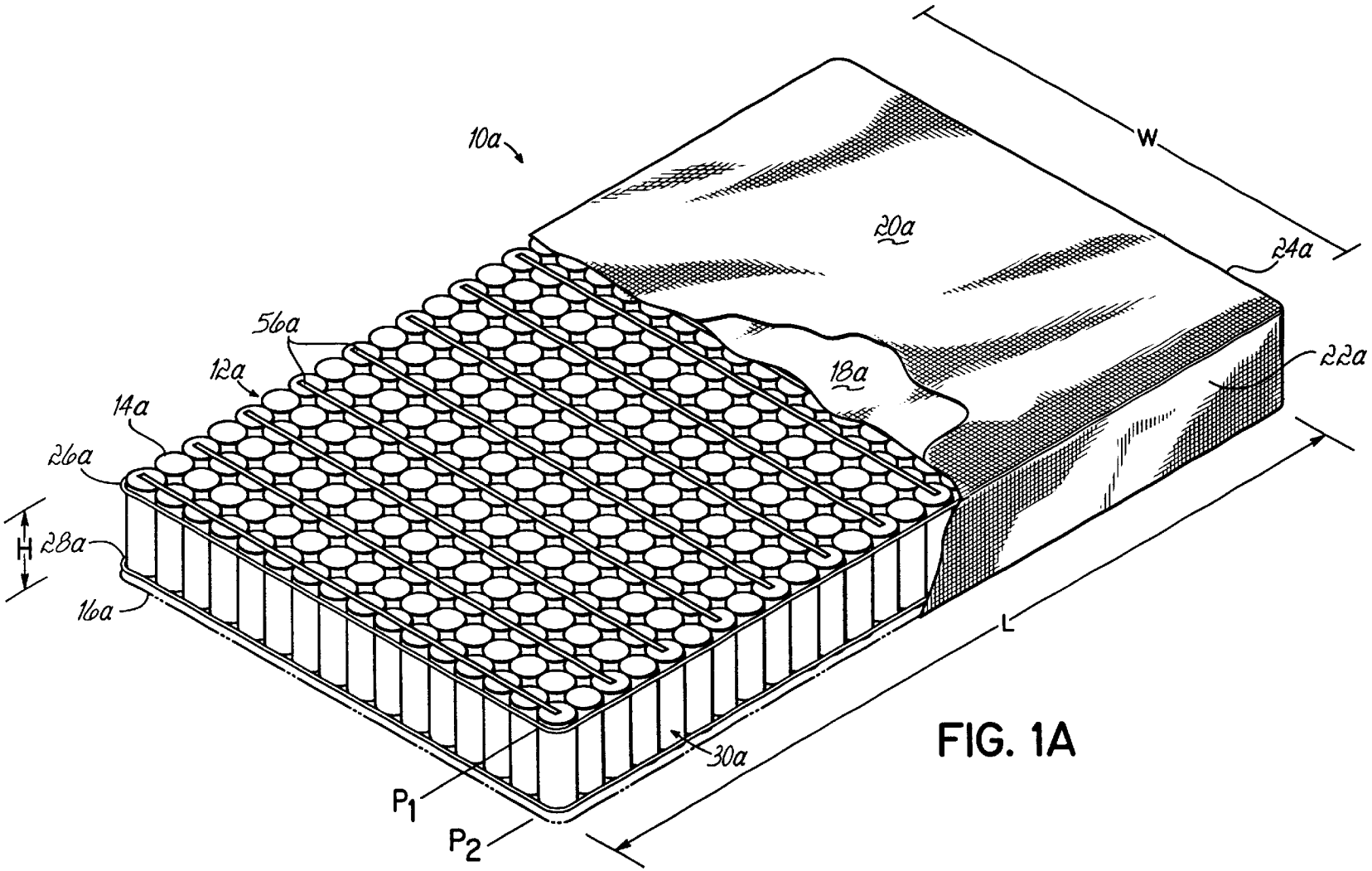
FIG. 1A is a perspective view of a bedding or seating product having a pocketed spring assembly according to another preferred embodiment of this invention.

FIG. 1A illustrates an alternative preferred embodiment of the present invention. In this preferred embodiment, a mattress 10*a* comprises a pocketed spring assembly 12*a*, padding 18*a* and an upholstered covering 20*a*. Pocketed spring assembly 12*a* has a generally planar top surface 14*a* in a top plane P1 and a parallel generally planar bottom surface 16*a* in a bottom plane P2. Upper and lower border wires 26*a*, 28*a* surround the pocketed spring assembly 12*a*. The mattress 10 has a transverse dimension or width W defined as the distance between opposed side surfaces 22*a* and a longitudinal dimension or length L defined as the distance between opposed end surfaces 24*a* of the mattress 10*a*.

The pocketed spring assembly 12*a* comprises transversely extending strings of springs 30*a* which extend from side-to-side, as opposed to end-to-end. Adjacent strings of springs 30*a* are secured together in any known manner to form the pocketed spring assembly 12*a*. In this alternative embodiment, plastic spacer strips 56*a* are secured to only select strings of springs. In FIG. 1A, every other string of springs 30*a* has a plastic spacer strip 56*a* secured thereto. Each of the strings of springs 30*a* is formed as described above and shown in FIG. 2. However, it is within the contemplation of the present invention, that every third string of springs 30*a* have a plastic spacer strip 56*a* secured thereto or some other like pattern. In this embodiment in which not every string of springs has a plastic spacer strip, the strings of springs may extend longitudinally rather than transversely as illustrated in FIG. 1A. In any of the embodiments of the present invention including the embodiment illustrated in FIG. 1A, more than one spacer strip be attached to the upper, lower or side surface of a string of springs.

Figure 3:
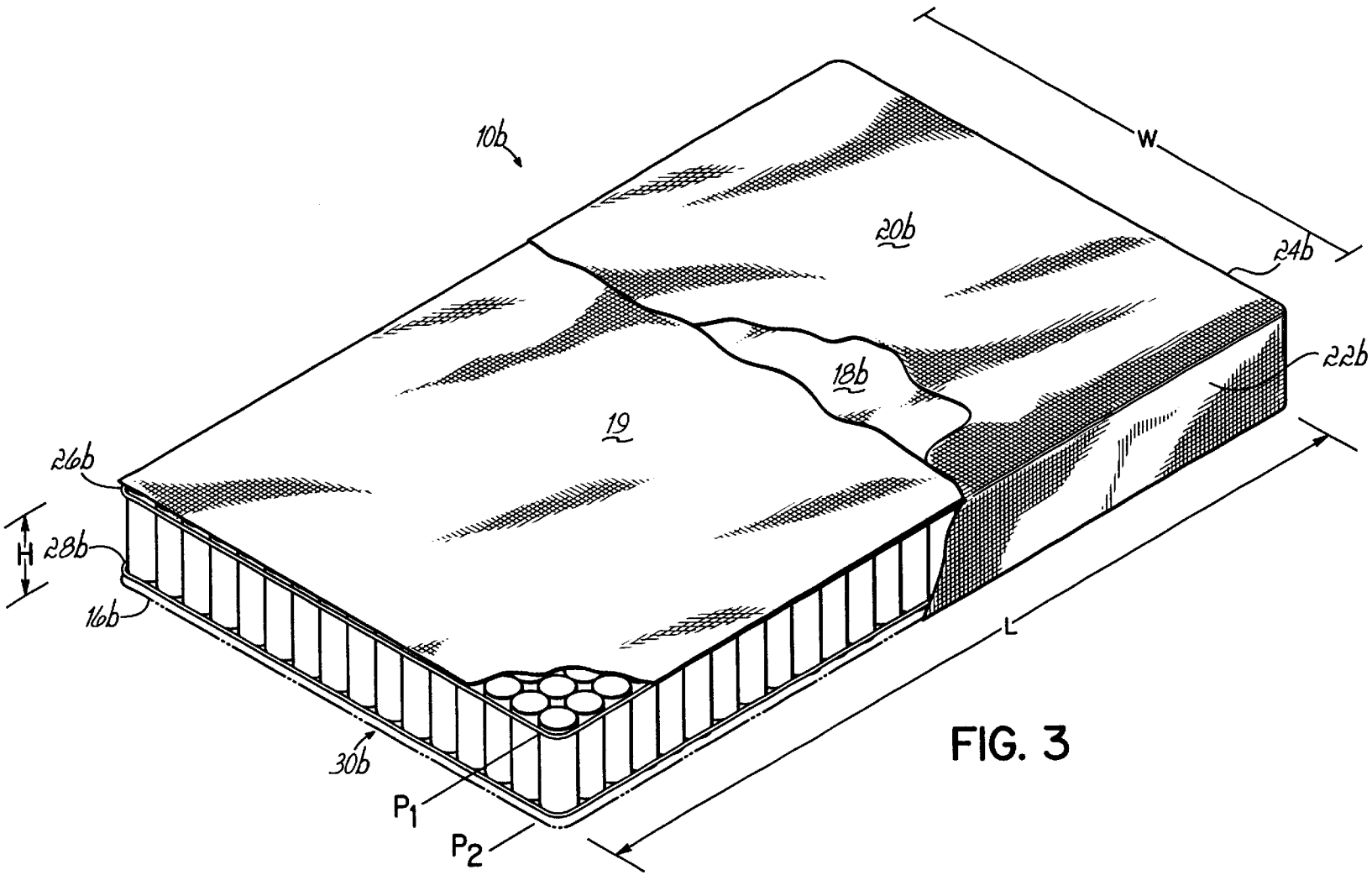
FIG. 3 is a perspective view of a bedding or seating product having a pocketed spring assembly according to another preferred embodiment of this invention.

FIG. 3 illustrates an alternative preferred embodiment of the present invention. In this preferred embodiment, a mattress 10*b* comprises a pocketed spring assembly 12*b*, padding 18*b* and an upholstered covering 20*b*. Pocketed spring assembly 12*b* has a generally planar top surface 14*b* in a top plane P1 and a parallel generally planar bottom surface 16*b* in a bottom plane P2. Upper and lower border wires 26*b*, 28*b* surround the pocketed spring assembly 12*b*. The mattress 10*b* has a transverse dimension or width W defined as the distance between opposed side surfaces 22*b* and a longitudinal dimension or length L defined as the distance between opposed end surfaces 24*b* of the mattress 10*b*.

The pocketed spring assembly 12*b* comprises longitudinally extending strings of springs 30*b* which extend from end-to-end. However, the strings of springs may extend transversely in accordance with this embodiment of the present invention. Adjacent strings of springs 30*b* are secured together in any known manner to form the pocketed spring assembly 12*b*. In this alternative embodiment, at least one scrim sheet 19 is secured to strings of springs 30*b*. In this embodiment, the scrim sheet 19 may be secured to the upper or lower surfaces of the strings of springs 30*b* with glue, ultasonic welds or any other suitable method. The scrim sheet or sheets 19 are used rather than plastic spacer strips to prevent the strings of springs 30*b* from collapsing along their lengths in the manner described hereinabove. Each of the strings of springs 30*b* is formed as described above and shown in FIG. 2. However, it is within the contemplation of the present invention, that the string of springs 30*b* be made in other ways. In this embodiment, the strings of springs may extend transversely as well.

The process of making a string of springs 30 having pockets with coil springs therein, like the string of springs 30 illustrated in FIG. 2, includes inserting the coil springs 34 into the pockets 32. Each of the pockets 32 are then closed or sealed along the longitudinal line of attachment or seam 52 which extends along the top, bottom or side of the string of springs 30. Fabric then encases at least one coil spring 34 in each pocket 32. The string of springs is then joined to adjacent strings of springs to make the pocketed spring assembly 12. At least one plastic strip 56 is then secured to each string of springs 30, connecting the pockets 32 of the string of springs 30. The plastic strip 56 may be secured by glue, or any other similar method. Lastly, the pocketed spring assembly 12 is covered with padding 18 and encased in an upholstered covering 20, as is conventional.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A bedding or seating product comprising:

a pocketed spring assembly comprising a plurality of parallel strings of springs joined to each other, each of said strings of springs comprising a row of interconnected pockets, each of said pockets containing at least one coil spring encased in fabric, each of said coil springs having an upper end turn, a lower end turn and a plurality of central convolutions between said end turns;

each of said strings of springs having more than one line of attachment between at least selected adjacent pockets;

at least one plastic spacer strip extending between said interconnected pockets of said strings of springs and secured thereto; and an upholstered covering surrounding said pocketed spring assembly.

2. A bedding or seating product comprising:

a pocketed spring assembly comprising a plurality of parallel strings of springs joined to each other, each of said strings of springs comprising a row of interconnected pockets, each of said pockets containing at least one coil spring encased in fabric, each of said coil springs having an upper end turn, a lower end turn and a plurality of central convolutions between said end turns;

each of said strings of springs having more than one line of attachment between at least selected adjacent pockets; and at least one plastic spacer strip extending between said interconnected pockets of said strings of springs and secured thereto.

3. The product of claim 2 wherein the strings of springs extend longitudinally.

4. The product of claim 2 wherein the strings of springs extend transversely.

5. The product of claim 2 wherein each spacer strip is made of extruded plastic and is glued to said strings of springs.

6. The product of claim 2 wherein each spacer strip is relatively rigid and is secured to a top surface at least selected ones of said strings of springs.

7. The product of claim 2 wherein each spacer strip is secured to a bottom surface of said strings of springs.

8. A bedding or seating product comprising:

a pocketed spring assembly comprising a plurality of parallel strings of springs joined to each other, each of said strings of springs comprising a row of interconnected pockets, each of said pockets containing at least one spring encased in fabric;

each of said strings of springs having more than one line of attachment between at least selected ones of adjacent pockets of said string; and at least one plastic spacer strip extending between said interconnected pockets of at least one of said strings of springs and secured thereto.

9. The product of claim 8 wherein each of said springs is a coil spring having each of said springs having an upper end turn, a lower end turn and a plurality of central convolutions between said end turns.

10. A bedding or seating product comprising:

a pocketed spring assembly comprising a plurality of parallel strings of springs joined to each other, each of said strings of springs comprising a row of interconnected pockets, each of said pockets containing at least one spring encased in fabric;

each of said strings of springs having more than one line of attachment between selected adjacent pockets; and at least one relatively rigid spacer strip extending between said interconnected pockets of at least one of said strings of springs and secured thereto.

11. The product of claim 10 wherein said spacer strip is plastic.

12. The product of claim 10 wherein each of said springs is a coil spring having an upper end turn, a lower end turn and a plurality of central convolutions between said end turns.

13. A bedding or seating product comprising:

a pocketed spring assembly comprising a plurality of parallel strings of springs joined to each other, each of said strings of springs comprising a row of interconnected pockets, each of said pockets containing at least one coil spring encased in fabric, each of said coil springs having a central axis, an upper end turn, a lower end turn and a plurality of central convolutions between said end turns;

some of said strings of springs having more than one line of attachment between selected adjacent pockets; and at least one relatively rigid spacer strip extending between said interconnected pockets and secured thereto, wherein said spacer strip intersects the central axes of said coil springs.

14. The product of claim 13 wherein said spacer strip is plastic.

15. A bedding or seating product comprising:

a pocketed spring assembly comprising a plurality of parallel strings of springs joined to each other, each of said strings of springs comprising a row of interconnected pockets, each of said pockets containing at least one coil spring encased in fabric, each of said coil springs having an upper end turn, a lower end turn and a plurality of central convolutions between said end turns;

some of said strings of springs having more than one line of attachment between selected adjacent pockets; and at least two relatively rigid spacer strips extending between said interconnected pockets of said strings of springs and secured thereto.

16. The product of claim 15 wherein at least one spacer strip is secured to a top surface of said strings of springs and at least one spacer strip is secured to a bottom surface of said strings of springs.

17. A method of manufacturing a bedding or seating product comprising:

forming a plurality of strings of pocketed springs, each of said strings of pocketed springs comprising a row of interconnected pockets by inserting a coil spring into said pockets and closing said pockets;

joining said strings of springs to form a pocketed spring assembly;

securing at least one relatively rigid plastic spacer strip to said interconnected pockets of at least one of said strings of springs; and encasing said pocketed spring assembly in a fabric covering.

18. A method of manufacturing a bedding or seating product comprising:

forming a plurality of strings of pocketed springs, each of said strings of pocketed springs comprising a row of interconnected pockets by inserting a coil spring into said pockets and closing said pockets;

joining said strings of springs to form a spring assembly; and securing at least one relatively rigid plastic spacer strip to said interconnected pockets to said strings of springs.

19. The method of claim 18 wherein said spacer strip is secured with glue to said pockets.

* * * * *

UNITED STATES PATENT AND TRADEMARK OFFICE

CERTIFICATE OF CORRECTION

PATENT NO. : 6,829,798 B2
APPLICATION NO. : 10/338241
DATED : December 14, 2004
INVENTOR(S) : Thomas J. Wells It is certified that error appears in the above-identified patent and that said Letters Patent is hereby corrected as shown below:

Column 3

Line 36, insert --the-- after "from".

Column 4

Line 62, change "pocketing" to --pocketed--.

Column 5

Line 48, after "strip", insert --may--.

Column 6

Line 18, change "are" to --is--.

Column 7

Line 29, delete "each of said springs having".

Column 8

Line 51, change "to" to --of--.

Signed and Sealed this

First Day of January, 2008

JON W. DUDAS
*Director of the United States Patent and Trademark Office*